US009278541B2

(12) United States Patent
Yashiro et al.

(10) Patent No.: US 9,278,541 B2
(45) Date of Patent: Mar. 8, 2016

(54) RECORDING HEAD

(71) Applicant: CANON KABUSHIKI KAISHA, Tokyo (JP)

(72) Inventors: Takanori Yashiro, Kawasaki (JP); Toshiaki Kaneko, Tokyo (JP); Satoshi Shimazu, Kawasaki (JP); Naoya Tsukamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/625,500

(22) Filed: Feb. 18, 2015

(65) Prior Publication Data

US 2015/0231891 A1 Aug. 20, 2015

(30) Foreign Application Priority Data

Feb. 20, 2014 (JP) ..... 2014-031126

(51) Int. Cl.
*B41J 2/175* (2006.01)

(52) U.S. Cl.
CPC ..... *B41J 2/17533* (2013.01)

(58) Field of Classification Search
CPC .. B41J 2/1753; B41J 2/17513; B41J 2/17536; B41J 2/16505; B41J 2/1433
USPC ..... 347/87
See application file for complete search history.

(56) References Cited

U.S. PATENT DOCUMENTS

| | | | | |
|---|---|---|---|---|
| 5,940,104 | A * | 8/1999 | Karita et al. | 347/87 |
| 6,634,732 | B2 * | 10/2003 | Farr et al. | 347/29 |
| 6,752,492 | B2 * | 6/2004 | Hirosawa et al. | 347/87 |
| 6,935,726 | B2 * | 8/2005 | Watanabe | 347/58 |
| 7,540,584 | B2 * | 6/2009 | Bertelsen et al. | 347/29 |
| 7,984,967 | B2 * | 7/2011 | Ikegame et al. | 347/47 |
| 8,087,749 | B2 * | 1/2012 | Goto et al. | 347/47 |

FOREIGN PATENT DOCUMENTS

JP 2011-194736 A 10/2011

* cited by examiner

*Primary Examiner* — Anh T. N. Vo
(74) *Attorney, Agent, or Firm* — Canon USA Inc. IP Division

(57) ABSTRACT

A recording head including: a supporting member including a depression and a peripheral portion in the periphery of the depression; a recording element substrate having an ejection port surface provided with an ejection port opening therein and arranged in the depression; and a tape adhered to the ejection port surface, wherein when viewing the recording head from above in a direction vertical to the ejection port surface, the recording element substrate and the peripheral portion are at least partly apart from each other via a groove, which is part of the depression, and the tape includes a portion located on the peripheral portion and a portion located on the groove at one lateral end thereof.

14 Claims, 6 Drawing Sheets

RECORDING HEAD

BACKGROUND OF THE INVENTION

1. Field of the Invention

This disclosure relates to a recording head.

2. Description of the Related Art

A recording apparatus represented by an inkjet printer includes a recording head. The recording head includes an ejection port opening on a surface (ejection port surface) thereof, and ink or the like is ejected from the ejection port and lands on a recording medium. In this manner, images and characters are recorded.

Adhering a tape which is referred to as a protective tape or the like on the ejection port of the recording head is known as described in Japanese Patent Laid-Open No. 2011-194736. Adhesion of the tape on the ejection port surface may restrain ink from evaporating from the ejection port surface and the ejection port surface from being scratched at the time of shipping, for example.

SUMMARY OF THE INVENTION

This disclosure provides a recording head including: a supporting member including a depression and a peripheral portion in the periphery of the depression; a recording element substrate having an ejection port surface provided with an ejection port opening therein and arranged in the depression; and a tape adhered to the ejection port surface, wherein when viewing the recording head from above in a direction vertical to the ejection port surface, the recording element substrate and the peripheral portion are at least partly apart from each other via a groove, which is part of the depression, and the tape includes a portion located on the peripheral portion and a portion located on the groove at one lateral end thereof.

Further features of the present invention will become apparent from the following description of exemplary embodiments with reference to the attached drawings.

DESCRIPTION OF THE EMBODIMENTS

Figure 5A:
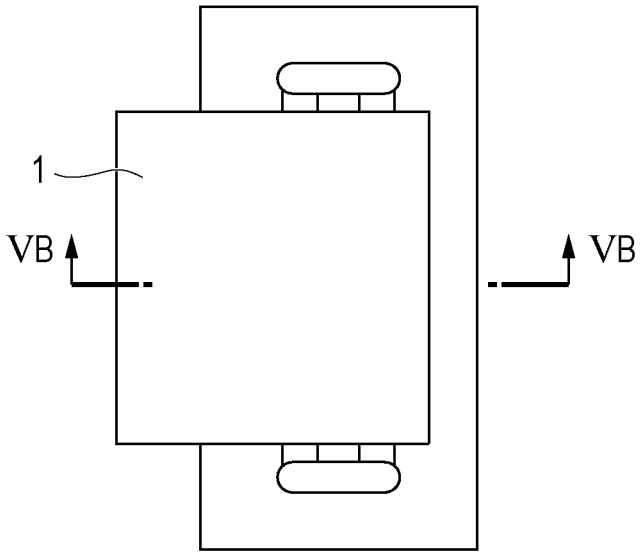
FIGS. 5A and 5B are drawings illustrating an example of the recording head.
Figure 5B:
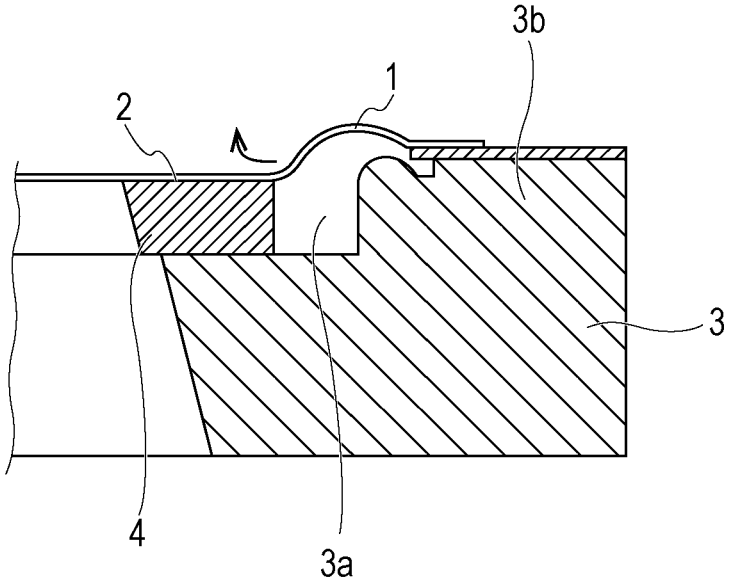

FIGS. 5A and 5B illustrate a state in which a tape is adhered to an ejection port surface of a recording head. FIG. 5A is a drawing of the recording head when viewed from above in a direction vertical to the ejection port surface of a recording element substrate 4. A tape 1 is adhered to an ejection port surface 2 of the recording element substrate 4.

FIG. 5B is a cross-sectional view taken along a line VB-VB of FIG. 5A. A supporting member 3 has a structure having a depression 3*a* and a peripheral portion 3*b* provided on the periphery of the depression and being one step higher than the depression. The recording element substrate 4 is arranged in the depression 3*a*. One lateral end of the tape 1 adhered to the ejection port surface is located entirely on the peripheral portion 3*b*. In other words, the entire part of the one lateral end of the tape 1 is in a state of being laid on the peripheral portion 3*b*.

According to the study, the present inventors found that the recording head has a problem of deflection of the tape 1.

Specifically, as illustrated in FIG. 5B, the tape 1 may be deflected at a position between the portion on the peripheral portion 3*b* and the portion on the recording element substrate 4, that is, on a portion over a groove, which is part of the depression 3*a*. When the deflection occurs on the tape 1, the tape 1 tends to be separated easily from an ejection port surface 2.

Figure 6A:
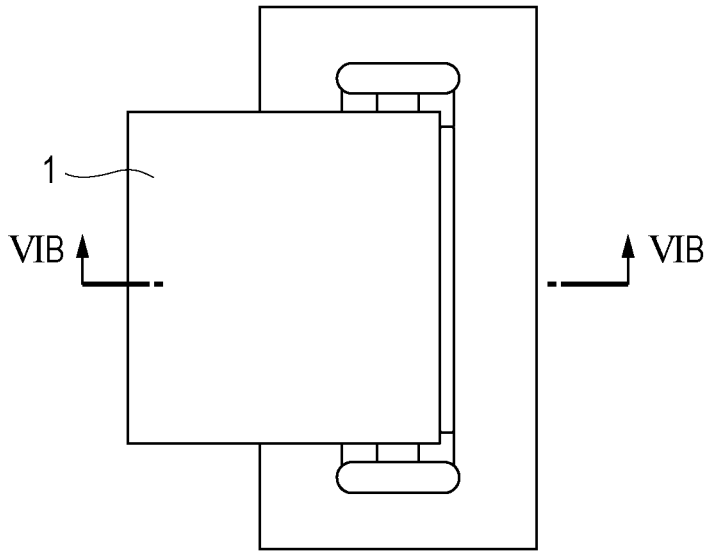
FIGS. 6A and 6B are drawings illustrating an example of the recording head.
Figure 6B:
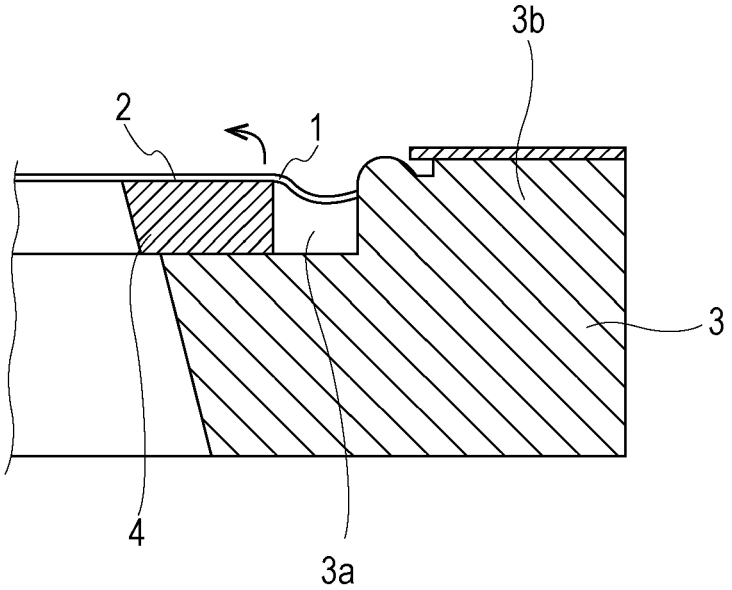

In contrast, FIG. 6A is a drawing of the recording head from the same position as FIG. 5A, and FIG. 6B is a cross-sectional view taken along a line VIB-VIB in FIG. 6A. In FIGS. 6A and 6B, the one lateral end of the tape 1 is located entirely on the portion on the groove, which is part of the depression. According to the study, the present inventors found that in the case as illustrated in FIGS. 6A and 6B, there is a problem that the deflection of the tape 1 occurs by the one lateral end of the tape 1 on the groove being caught by a side surface of the peripheral portion 3*b*, whereby the tape 1 is separated from the ejection port surface 2.

Therefore, this disclosure provides a recording head in which a tape can hardly be separated from an ejection port surface of a recording element substrate.

Figure 1:
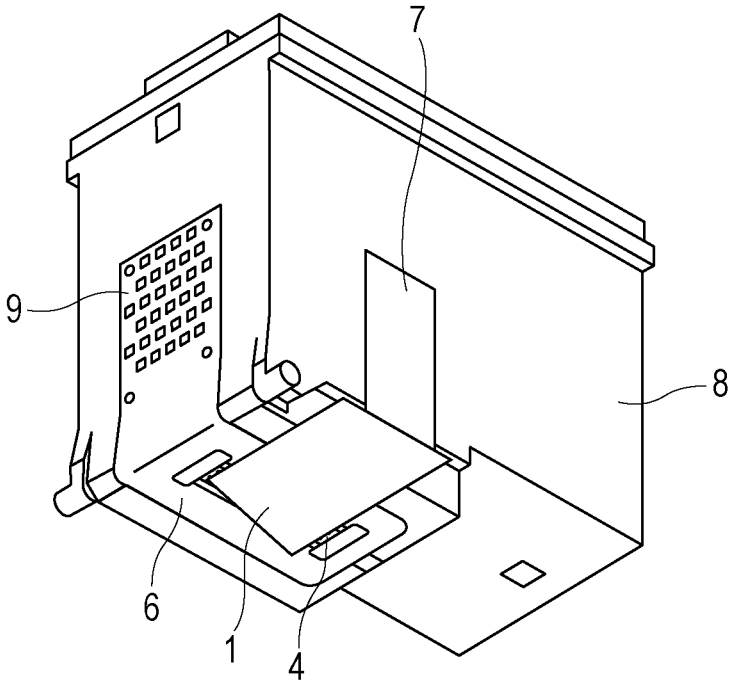
FIG. 1 is a drawing illustrating an example of a recording head of this disclosure.

Modes for carrying out this disclosure will be described below. FIG. 1 is a drawing illustrating an example of a recording head of this disclosure. The recording head described here is of a type integrated with a case 8 of an ink tank, and includes a recording element substrate 4, an electric wiring board 6, a tag tape 7, and a supporting member 3. The electric wiring board 6 includes an external signal input terminal 9. A surface of the recording element substrate 4 is an ejection port surface having an opening therein, and a tape 1 is adhered to the ejection port surface.

Figure 2A:
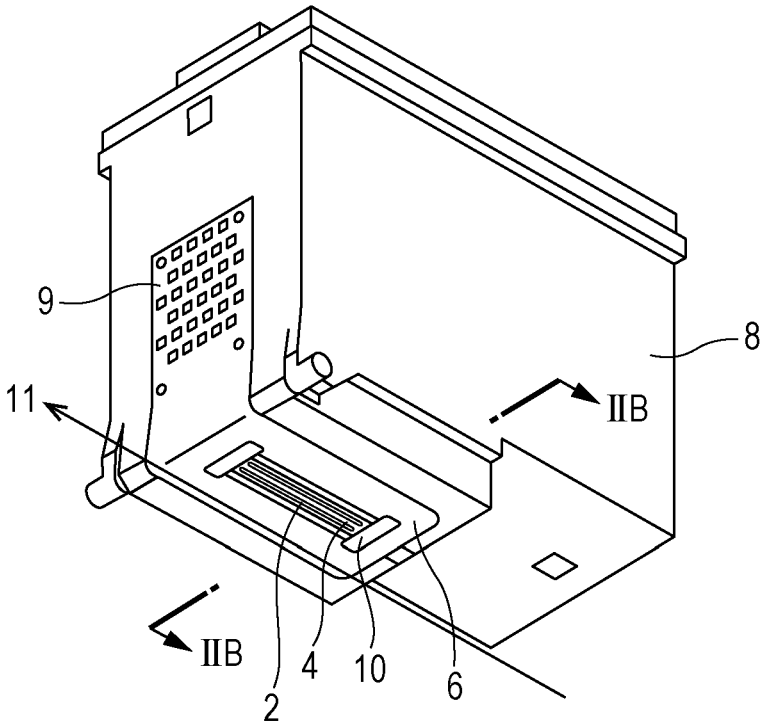
FIGS. 2A and 2B are drawings illustrating an example of the recording head of this disclosure.
Figure 2B:
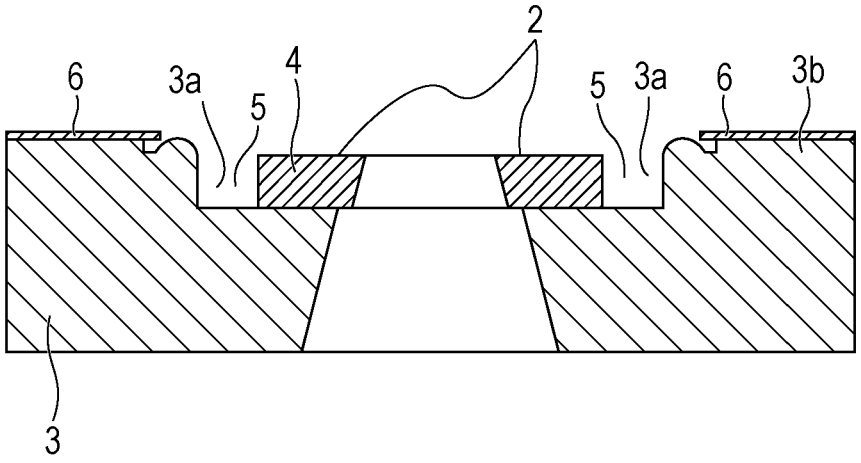

FIG. 2A is a drawing illustrating the same recording head as that illustrated in FIG. 1, and illustrates a state in which the tape is removed from the ejection port surface. FIG. 2B is a cross-sectional view taken along the line IIB-IIB of the recording head in FIG. 2A. An end of the recording element substrate 4 in a longitudinal direction 11 (an end extending along a short direction of the recording element substrate) is sealed by a sealing material 10. The recording element substrate 4 and the electric wiring board 6 are mounted on the supporting member 3. The electric wiring board 6 is also referred to as TAB and the like and is provided with a route through which an electric signal for ejecting ink or the like from the ejection port is applied to the recording element substrate 4. Examples of the electric wiring board 6 include a configuration in which a copper wiring line is formed on a polyimide film. The electric signal is transmitted from a printer body (not illustrated) via the external signal input terminal 9, and is further transmitted from the end of the recording element substrate in the longitudinal direction to the recording element substrate 4.

The recording element substrate 4 includes, for example, a silicon substrate formed of silicone and an ejection port forming member formed of a resin or an inorganic film on the silicon substrate. The ejection port forming member is provided with an ejection port and the surface in which the ejection port of the ejection port forming member is opened corresponds to the ejection port surface.

A supporting member has a configuration having a depression 3*a* and a peripheral portion 3*b* provided in the periphery of the depression 3*a* and being one step higher than the depression. The supporting member is formed for example of a resin such as modified polyphenylene ether or alumina. The recording element substrate 4 is arranged for example in the depression 3*a* with a silicone substrate of the recording element substrate 4 faced downward. The silicon substrate and an upper surface of the supporting member is adhered for example with an adhesive agent.

As illustrated in FIG. 2B, the recording element substrate 4 and the peripheral portion 3*b* are at least partly away from each other via a groove 5, which is part of the depression 3*a*. In other words, when the recording element substrate 4 is arranged in the depression 3*a* of the supporting member, a portion of a gap between the supporting member and the recording element substrate corresponds to the groove 5. The groove 5 is formed between the recording element substrate 4 and the peripheral portion 3*b*. In FIG. 2B the groove is formed along the longitudinal direction of the recording element substrate 4. The groove 5 may be formed over the entire circumference of the recording element substrate 4. At least part of the groove 5 may be sealed with a sealing material or the like. For example, part on the outside of the recording element substrate 4 along the short side direction of the recording element substrate 4 may be provided with wiring line or the like for inner lead bonding (ILB), and a groove under the ILB may be sealed with the sealing material together.

An upper surface of the peripheral portion 3*b*, that is, a surface in contact with the electric wiring board 6 of the peripheral portion 3*b* in FIG. 2B is located at a position higher than the ejection port surface 2 of the recording element substrate 4. In terms of a distance from a recording medium on which a material ejected from the ejection port (ink for example) is landed, the upper surface of the peripheral portion 3*b* is located at a position closer to the recording medium than the ejection port surface 2. In this manner, in the case where the upper surface of the peripheral portion 3*b* is located at a position higher than the ejection port surface 2, a deflection of a tape, which will be described later, tends to occur.

As illustrated in FIG. 1, the tape 1 is adhered to the ejection port surface 2 of the recording element substrate 4. The tape 1 preferably covers the ejection port of the ejection port surface 2. Preferably, the tag tape 7 is joined to one side of the tape 1 from the view point of separating property when separating the tape 1.

Figure 3A:
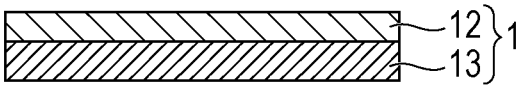
FIGS. 3A and 3B are drawings illustrating an example of the recording head of this disclosure.

Subsequently, the structure of the tape 1 of the recording head of this disclosure will be described. FIG. 3A is a cross-sectional view of the tape 1. The tape 1 has, for example, a two layer structure, and is formed of a base material 12 that is PET or the like and an adhesive layer 13. The thickness of the base material 12 preferably falls within a range from 10 μm to 40 μm. The thickness of the adhesive layer preferably falls within a range from 20 μm to 60 μm. The adhesive layer 13 is a portion opposing the ejection port surface 2, and the adhesive layer 13 and the ejection port surface 2 are adhered to each other.

Figure 3B:
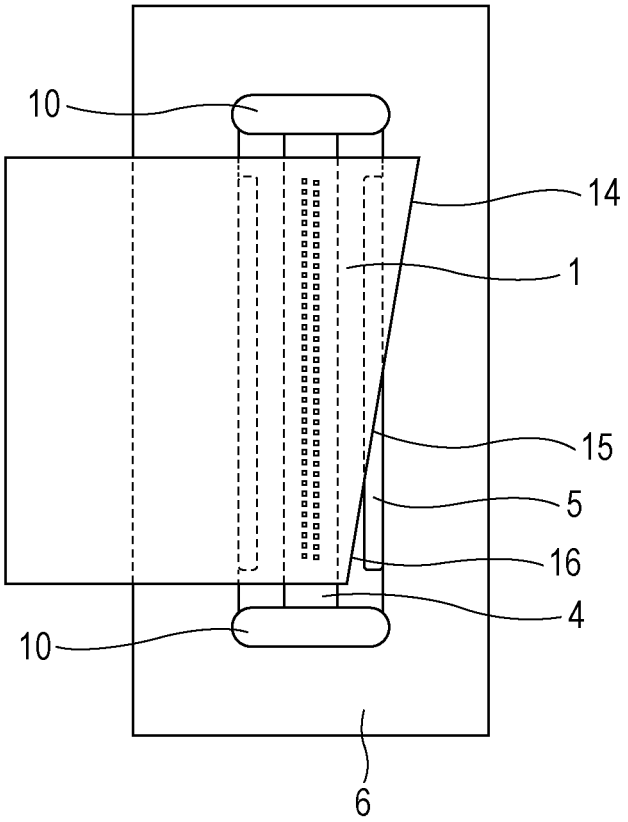

FIG. 3B is a drawing of the recording head when viewed from above in a direction vertical to the ejection port surface 2 of the recording element substrate 4. The recording element substrate and the peripheral portion of the supporting portion are at least partly apart from each other via a groove, which is part of the depression. In FIG. 3B, the one lateral end of the tape 1 is obliquely cut. Normally, the one lateral end of the tape 1 is arranged in parallel with the one lateral end of the recording element substrate in the short side direction (parallel to the vertical direction in FIG. 3B). However, in the recording head of FIGS. 3A and 3B, the one lateral end of the tape 1 is arranged obliquely with respect to the one lateral end of the recording element substrate in the short side direction (outer periphery along the longitudinal direction of the recording element substrate). In other words, the one lateral end of the tape 1 intersects obliquely with the longitudinal direction of the recording element substrate 4. The one lateral end of the tape 1 includes a portion 14 located on the peripheral portion, a portion 15 on the groove 5, and a portion 16 located on the ejection port surface 2 of the recording element substrate. In FIG. 3B, it can be said that the electric wiring board 6 is formed on the peripheral portion, and the portion 14 located on the peripheral portion is formed on the electric wiring board 6. The one lateral end of the tape 1 is preferably joined so as to bypass the sealing material 10. The width of the tape 1 is preferably not smaller than the length of the ejection port row and not larger than the interval of the sealing materials 10 located at both ends in the longitudinal direction in the vertical direction of FIG. 3B.

In the tape illustrated in FIGS. 5A and 5B, the one lateral end of the tape 1 adhered to the ejection port surface is located entirely on the peripheral portion 3*b*. In contrast, in FIG. 3B, the one lateral end of the tape is partly positioned on the peripheral portion 3*b* and partly on the groove 5. In other words, since all of the one lateral end of the tape is not necessarily located on the peripheral portion 3*b*, the length of the tape formed on the peripheral portion is reduced (or the surface area is reduced), so that the probability of occurrence of the deflection as illustrated in FIG. 5B is reduced.

In the tape illustrated in FIGS. 6A and 6B, the one lateral end of the tape 1 is located entirely on the groove 5. In contrast, in FIG. 3B, the one lateral end of the tape is partly positioned on the peripheral portion 3*b* and partly on the groove 5. In other words, not the entire part of the one lateral end of the tape is located on the groove 5, but is partly located on the peripheral portion 3*b*, so as to straddle a boundary line between the peripheral portion 3*b* and the groove 5. The entire part of the tape is supported by this straddled portion, so that the probability of occurrence of the deflection as illustrated in FIG. 6B is reduced.

The groove in which the one lateral end of the tape 1 is formed on an upper part is preferably a groove extending along the longitudinal direction of the recording element substrate 4.

The ratio of the length of the one lateral end of the tape 1 of a portion located on the peripheral portion 3*b* is preferably not larger than 70%, further preferably not larger than 50%, and still further preferably not larger than 40%. Reduction of the ratio of the length of the one lateral end of the tape 1 of a portion located on the peripheral portion 3*b* helps to restrain the occurrence of the deflection. In order to restrain the deflection in terms of the support of the entire tape, the length of the one lateral end of the tape 1 of the portion located on the peripheral portion 3*b* is preferably not smaller than 10%.

As described above, with the one lateral end of the tape located partly on the peripheral portion 3*b* and partly on the groove 5, the occurrence of the deflection of the tape may be restrained. Consequently, separation of the tape from the ejection port surface caused by the deflection may be restrained.

The one lateral end of the tape includes a portion located on the peripheral portion, a portion on the groove, and a portion located on the ejection port surface. In this case, the portion located on the peripheral portion and the portion located on the ejection port surface form a bridge over the groove, so that the force that support the tape becomes stronger. Therefore, the probability of occurrence of separation of the tape from the ejection port surface is further reduced. However, a method of adhering the tape on the ejection port surface by sticking and holding the tape is generally used when adhering the tape on the ejection port surface. In this case, the ejection port and the sticking portion are separated so as to prevent the ejection port from being affected by the stickiness. With this configuration, it is difficult to position the one lateral end of the tape on the ejection port surface in terms of the manufacturing process, and hence a configuration having the portion located on the peripheral portion and the portion located on the groove, but not having portion located on the ejection port surface is preferable.

One lateral end on a side opposite from the one lateral end of the tape described thus far may have the practically same shape. For example, the tape may be a parallelogram. In the case of having the same shape as described above, generation of waste may be restrained when manufacturing the tape by cutting. For example, the tapes being the parallelogram may be manufactured continuously while restraining generation of waste.

Figure 4A:
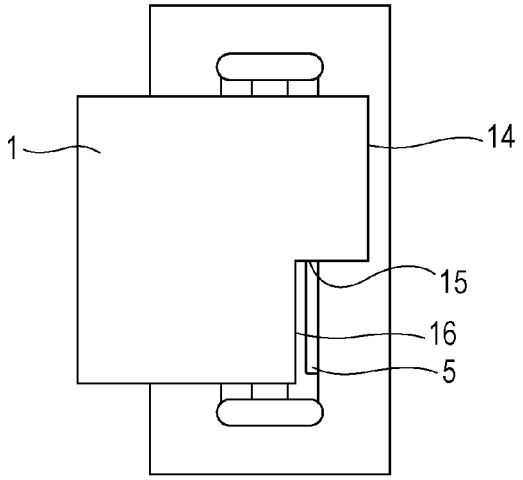
FIGS. 4A to 4C are drawings illustrating an example of the recording head of this disclosure.

The structure of the tape 1 of the recording head of this disclosure is not limited to the structure illustrated in FIG. 3B. For example, the structure illustrated in FIG. 4A is also applicable. FIG. 4A is a drawing of the recording head when viewed from above in a direction vertical to the ejection port surface in the same manner as FIG. 3B. In the recording head illustrated in FIG. 4A as well, the tape 1 includes the portion 14 located on the peripheral portion and the portion 15 located on the groove at one lateral end thereof. In addition, the one lateral end of the tape 1 includes the portion 16 located on the ejection port surface. In this recording head as well, since the one lateral end of the tape 1 includes the portion 14 located on the peripheral portion and the portion 15 located on the groove, separation of the tape 1 from the ejection port surface of the recording element substrate may be prevented from the same reason as the description in conjunction with FIG. 3B. In FIG. 4A, the one lateral end of the tape 1 has a staircase shape having two steps including one level difference. However, a plurality of level differences may be provided.

With the configuration in FIG. 4A, part of the one lateral end of the tape 1 may be configured to be parallel to the longitudinal direction of the recording element substrate. In this configuration, the position of the tape 1 with respect to the ejection port surface of the recording element substrate may be measured easily, so that the tape 1 can be adhered to the ejection port surface with high degree of accuracy. Part (part on the groove) of the one lateral end of the tape 1 may be configured to be parallel to the short side direction of the recording element substrate.

Figure 4B:
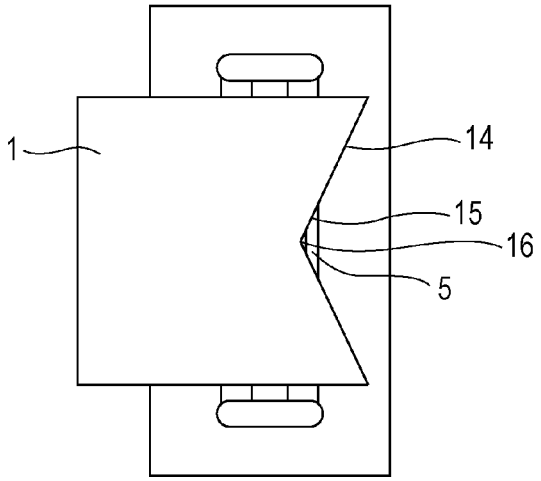

Examples of the structure of the tape 1 of the recording head include a structure illustrating in FIG. 4B. FIG. 4B is a drawing of the recording head when viewed from above in a direction vertical to the ejection port surface in the same manner as FIG. 3B. In this example, the one lateral end of the tape 1 is cut so as to form a projecting shape on a center side. The tape 1 includes the portion 14 located on the peripheral portion and the portion 15 located on the groove at one lateral end on the outer periphery thereof. The tape 1 also includes the portion 16 located on the ejection port surface. The projecting shape may be a triangle as illustrated in FIG. 4B or, for example, an oval. Even when the one lateral end of the tape having the projecting shape is arranged as illustrated in FIG. 4B, separation of the tape 1 from the ejection port surface of the recording element substrate may be restrained in the same manner as described in conjunction with FIG. 3B. In this case, the portion of the one lateral end of the tape 1 located on the groove may be formed at two positions. Therefore, support of the tape 1 is achieved at the two positions, and hence the occurrence of the deflection may be desirably restrained. By forming a plurality of projecting shapes, the positions at which the tape is supported is preferably increased.

Figure 4C:
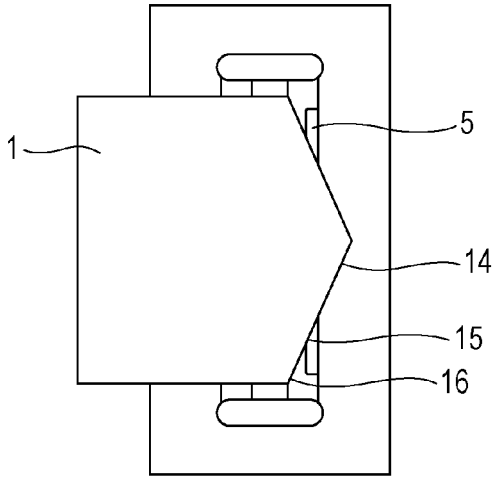

Examples of the structure of the tape 1 of the recording head includes a structure illustrated in FIG. 4C. FIG. 4C is a drawing of the recording head when viewed from above in a direction vertical to the ejection port surface in the same manner as FIG. 3B. In this example, the projecting shape in FIG. 4B is replaced by the depressed shape. The one lateral end of the tape 1 includes the portion 14 located on the peripheral portion, the portion on the groove, and the portion 16 located on the ejection port surface illustrated in FIG. 4C. The number of depressed portion of the depressed shape may be either one or plural as illustrated in FIG. 4C. The shape of the depression may be either triangle, square, or oval. Even when the one lateral end of the tape having the depressed shape is arranged as illustrated in FIG. 4C, separation of the tape 1 from the ejection port surface of the recording element substrate may be restrained in the same manner as described in conjunction with FIG. 3B. Furthermore, in a mode having a depressed shape, the position located on the groove 5 or the position straddling the groove 5 is increased in the one lateral end of the tape 1, so that the shape is preferably supported further firmly.

In this manner, as an example of the one lateral end of the tape, the stepped shape, the projecting shape, and the depressed shape have been described. These shapes may be combined. For example, the projecting shape is provided at one portion and the depressed shape is provided at another portion is also applicable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-031126, filed Feb. 20, 2014 which is hereby incorporated by reference herein in its entirety.

What is claimed is:

1. A recording head comprising:

a supporting member including a depression and a peripheral portion in the periphery of the depression;

a recording element substrate having an ejection port surface provided with an ejection port opening therein and arranged in the depression; and a tape adhered to the ejection port surface, wherein when viewing the recording head from above in a direction vertical to the ejection port surface, the recording element substrate and the peripheral portion are at least partly apart from each other via a groove, which is part of the depression, and the tape includes a first edge and a second edge, which face each other, and a third edge connecting the first edge and the second edge, the first edge and the second edge extending along a short direction of the recording element substrate, the third edge including a portion located on the peripheral portion and a portion located on the groove.

2. The recording head according to claim 1, wherein an upper surface of the peripheral portion is located at a position higher than the ejection port surface.

3. The recording head according to claim 1, wherein the groove on which the portion of the third edge of the tape is located is an upper part of a groove extending along a longitudinal direction of the recording element substrate.

4. The recording head according to claim 1, wherein when viewing the recording head from above in the direction vertical to the ejection port surface, the third edge of the tape intersects obliquely with a longitudinal direction of the recording element substrate.

5. The recording head according to claim 1, wherein when viewing the recording head from above in the direction vertical to the ejection port surface, the third edge of the tape includes a portion parallel to a longitudinal direction of the recording element substrate.

6. The recording head according to claim 1, wherein when viewing the recording head from above in the direction vertical to the ejection port surface, the third edge of the tape includes a portion perpendicular to a longitudinal direction of the recording element substrate.

7. The recording head according to claim 1, wherein when viewing the recording head from above in the direction vertical to the ejection port surface, the third edge of the tape has a projecting shape.

8. The recording head according to claim 1, wherein when viewing the recording head from above in the direction vertical to the ejection port surface, the third edge of the tape has a depressed shape.

9. The recording head according to claim 1, wherein when viewing the recording head from above in the direction vertical to the ejection port surface, the ratio of the length of the portion located on the peripheral portion of the third edge of the tape is not larger than 70%.

10. The recording head according to claim 1, wherein when viewing the recording head from above in the direction vertical to the ejection port surface, the percentage of the length of the portion located on the peripheral portion of the third edge of the tape is not smaller than 10%.

11. The recording head according to claim 1, wherein when viewing the recording head from above in the direction vertical to the ejection port surface, the third edge of the tape includes a portion located on the ejection port surface.

12. The recording head according to claim 1, wherein when viewing the recording head from above in the direction vertical to the ejection port surface, the third edge of the tape does not include a portion located on the ejection port surface.

13. The recording head according to claim 1, wherein the recording element substrate has an ejection port row in which a plurality of ejection port openings is provided, and wherein the first edge of the tape is located adjacent to an ejection port opening provided on an end side of the ejection row, and the second edge of the tape is located adjacent to an ejection port opening provided on another end side of the ejection row.

14. The recording head according to claim 1, wherein an entire portion of the third edge of the tape is located on a side of the ejection port surface.

* * * * *